United States Patent [19]

Lundén

[11] Patent Number: 4,524,895

[45] Date of Patent: Jun. 25, 1985

[54] HOLDER FOR PAPER ROLL WITH CENTRAL DISPENSING OF THE PAPER

[75] Inventor: Bertil Lundén, Hovås, Sweden

[73] Assignee: Molnlycke AB, Goteborg, Sweden

[21] Appl. No.: 475,632

[22] Filed: Mar. 15, 1983

[30] Foreign Application Priority Data

Apr. 1, 1982 [SE] Sweden ..... 8202091

[51] Int. Cl.[3] ..... A47K 10/36

[52] U.S. Cl. ..... 225/19; 225/42; 225/77; 225/91; 225/106

[58] Field of Search ..... 225/42, 19, 77, 106, 225/91

[56] References Cited

U.S. PATENT DOCUMENTS

| | | | |
|---|---|---|---|
| 1,837,180 | 12/1931 | Bennett, Jr. et al. | 225/19 X |
| 2,533,841 | 12/1950 | Russell | 225/42 X |
| 3,150,808 | 9/1964 | Vensel | 225/106 |
| 3,173,590 | 3/1965 | Bahnsen | 225/42 X |
| 3,868,052 | 2/1975 | Rockefeller | 225/106 |
| 3,986,479 | 10/1976 | Bonk | 225/106 X |
| 4,171,047 | 10/1979 | Doyle et al. | 225/106 X |
| 4,426,029 | 1/1984 | Kamp | 225/91 X |

FOREIGN PATENT DOCUMENTS

| | | | |
|---|---|---|---|
| 603638 | 4/1926 | France | 225/19 |
| 2063213 | 6/1981 | United Kingdom | 225/42 |

*Primary Examiner*—Frank T. Yost

*Attorney, Agent, or Firm*—Young & Thompson

[57] ABSTRACT

The invention relates to a holder for paper rolls with central dispensing of the paper from the interior of the roll. There is a pull-out opening for the paper web in one end wall of the holder, where it is surrounded by a projecting, substantially tubular, tearing device with tearing teeth for tearing off the paper web. According to the invention, the holder is firstly made so that it can be mounted in any position, and secondly its tearing device is provided with protective projections, which extend beyond the tearing teeth.

4 Claims, 13 Drawing Figures

HOLDER FOR PAPER ROLL WITH CENTRAL DISPENSING OF THE PAPER

The present invention relates to a holder for paper rolls with central dispensing of the paper from the interior of the roll, comprising a housing which can be mounted on a supporting surface such as a pillar or the like, and which has an end wall provided with a dispensing opening for the paper web, about which opening there is an at least substantially cylindrical tear means for the paper web, said tear means projecting from the end surface and having at its outer end tearing teeth for tearing off the paper web.

Holders of this type known up to now have a number of significant disadvantages. For example, in one of these holders, the tear means taper conically towards the toothed tear edge, which means that after tearing off a piece of paper the remaining end of the paper web can be left inside the tear means. In order to tear off a new piece of paper, it is then necessary to stick one's hand inside the toothed tear edge to grasp the web end. In addition to the difficulty of grasping the end of the paper web, there is a great risk of cutting oneself on the toothed edge. In another known holder, this problem has been eliminated by making the tear means in the shape of a cylindrical sleeve or a cone which widens downwards. In these embodiments, the free end of the paper web is always accessible without having to stick one's hand inside the toothed edge.

As was done in another known device, it is possible to provide the cylindrical tear means with a substantially larger radius than length, thus assuring that the free end of the paper web will always hang down below the toothed edge. This advantage over a cylindrical tear means of substantially smaller diameter is achieved, however, at the cost of function, since when tearing off a piece of paper with a tear means of large diameter, it is necessary to pull obliquely upwards in order to not pull out an excess of paper from the roll. A web of paper can be torn with tear means of substantially smaller diameter by pulling it laterally over the toothed edge of the cylinder.

Furthermore it is common to all of the previously known holders of this type, that the paper roll be carried by an end wall serving as a bottom plate, in which the opening for dispensing of the paper web is located. This means that all of these holders must be mounted so that the paper roll inside the same stands vertically, which means in turn that they must be mounted vertically on vertical walls or the like. Thus a great deal of vertical space is required since space is also required for pulling out the paper web.

A significant further disadvantage of previously known holders of the type described by way of introduction here, is that their tear teeth are so sharp that there is a great risk that a user will scratch or cut himself on them. Attempts have been made to use less sharp tear teeth but performance has then not been satisfactory. The function of the tear teeth is also entirely different than is the case for tear teeth in holders in which the paper web is pulled peripherally from the roll and torn against a straight toothed edge, the length of which corresponds to the width of the paper web. In such holders, the teeth do not need to be particularly sharp. In contrast to a peripherally dispensed paper web, a paper web pulled centrally out of the interior of a roll is gathered together, folded over itself several times, so that the total thickness is several times greater than the actual thickness of the paper web. The gathered web must therefore be torn off simultaneously along its entire width, which requires that the teeth of the tear means must be relatively sharp.

The present invention has the purpose of producing a new and improved paper roll holder of the type described by way of introduction, in which the problems discussed here have been eliminated.

A holder made according to the invention, in order to fulfill this purpose, is primarily characterized in that the paper roll is supported inside the holder regardless of the position in which the holder is mounted, that the tear means is provided at its outer end with spaced protective projections which extend outside the tearing teeth, one of which at least is disposed between adjacent protecting projections, and that one end wall or another portion of the housing can be opened.

The invention will be described in more detail in the following with reference to two examples shown in the accompanying drawings.

FIGS. 1*a* and 1*b* show a side view of a first embodiment for a paper roll holder according to the invention in the form of a sleeve and an end wall which can be locked thereto and which is provided with the required tear means.

FIG. 2*a* is a side view of the end wall shown in FIG. 1.

FIG. 2*b* is an enlargement of the portion within the oval in FIG. 2*a*.

FIG. 2*c* is a cross-section on the line IIc—IIc of FIG. 2*b*.

Figure 7A:
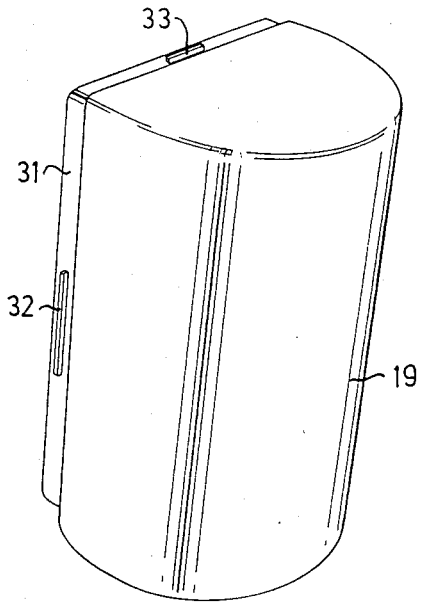
Figure 7B:
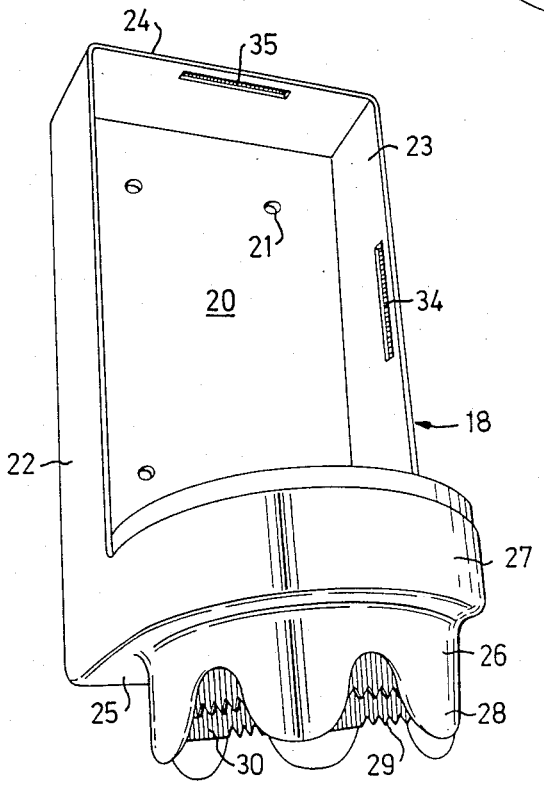

FIGS. 7*a* and 7*b* show in perspective the main components of another embodiment of a holder according to the invention.

Figure 8:
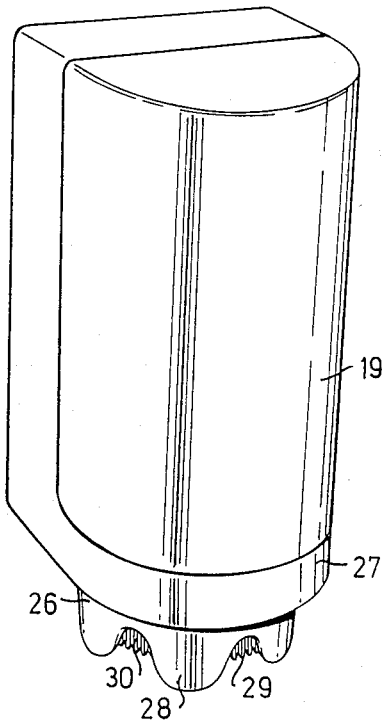
Figure 9:
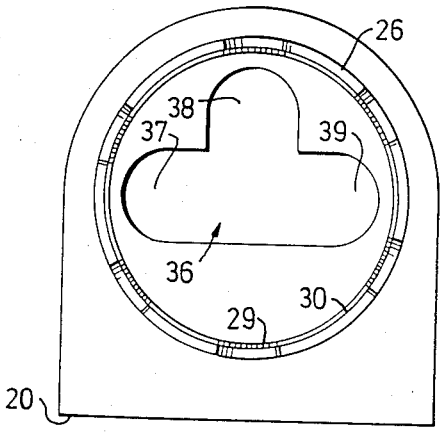

FIGS. 8 and 9 show from the side and from below, respectively, the holder in FIG. 7.

Figure 1A:
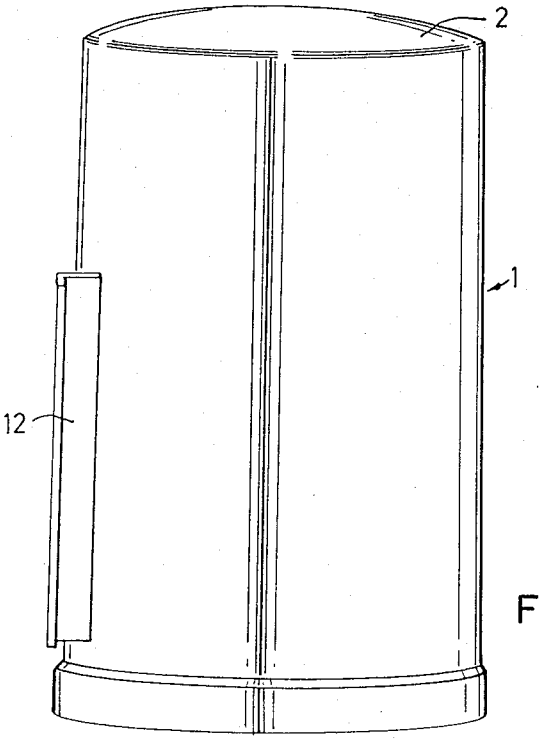
Figure 1B:
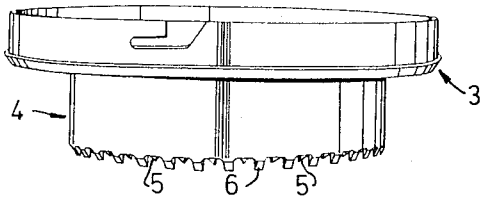

As can be seen in FIGS. 1*a* and 1*b*, a paper roll holder according to the invention can consist of a substantially cylindrical sleeve 1, which is closed at one end 2 and which can be closed at the other end by means of a cover-like end wall 3 partially insertable in said end. On said end wall, a tear means 4 is arranged for the paper web, consisting of a substantially cylindrical piece projecting from the end wall, which is provided at its free end with both tear teeth 5 and protective projections 6.

Figure 3:
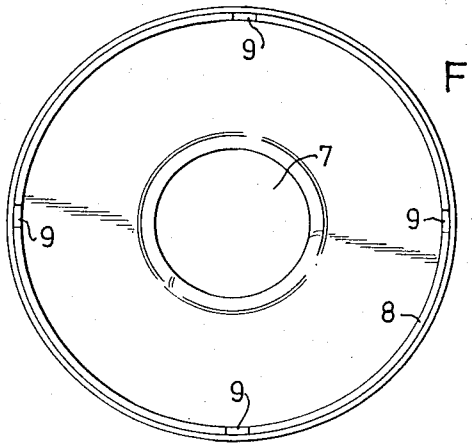
FIG. 3 is a top plan view of FIG. 2*a*.

The cover-like end wall 3 is, as can be seen especially well in FIG. 3, provided with a central hole 7, through which the paper web is pulled from the interior of a paper roll held in the holder. In an annular rim portion 8 for the end wall 3, there are a number of curved slots 9, for the bayonet coupling for joining the end wall 3 and the sleeve 1 to each other.

Figure 2A:
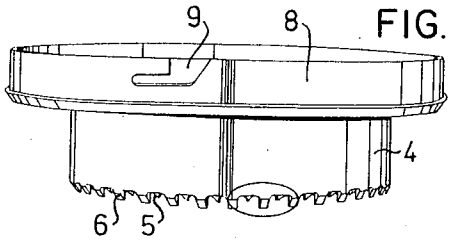
Figure 2B:
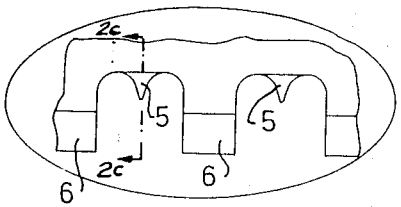
Figure 2C:
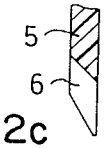

FIG. 2*a* shows on a larger scale two tearing teeth 5 with intermediate protective projections 6 on the tear means shown in FIG. 1*b*. FIG. 2*c* shows a section through a tearing tooth 5 along the line IIc—IIc in FIG. 2*b*. As can be seen from FIGS. 2*b* and 2*c*, and tearing teeth 5 are quite pointed, providing good tearing function, while the protective projections 6 are of the same width along their entire length, which is substantially greater than the length of the tearing teeth 5. The protective projections 6 thus prevent a user from scratching or cutting himself on the shorter, very sharp tearing teeth 5. The risk of scratching or cutting oneself is greatest when the user reaches towards the holder to grasp the free end of the paper web. When he has grasped the paper web, he pulls out the desired length, and snaps it to the side to tear off the paper. So that the user will not encounter any sharp edges, when he grasps after the paper web, both the long protective projections 6 and the shorter tearing teeth 5 are also bevelled upwardly outwardly as is best revealed in FIGS. 2*b* and 2*c*.

Figure 4:
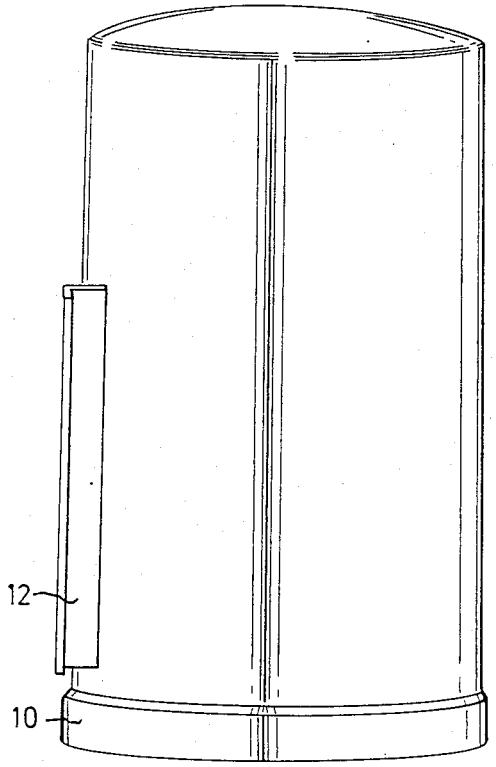
FIGS. 4 and 5 show from the side and from below, respectively, the sleeve in the holder in FIG. 1.
Figure 5:
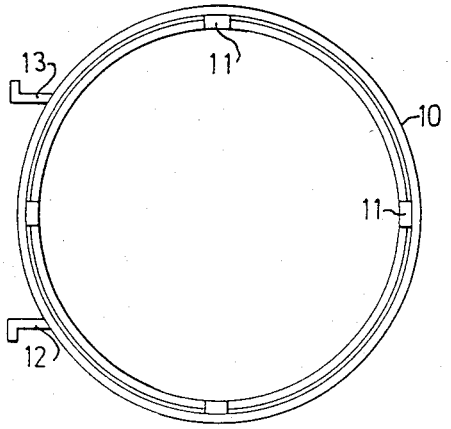

The sleeve 1 in the embodiment shown in FIG. 1*a* for a paper roll holder made according to the invention, as shown in detail in FIGS. 4 and 5. Inside an annular end portion 10, in which the annular, rim-like portion 8 of the end wall 3 is to be inserted, there are a number of radially projecting hooks which are adapted to engage in the slots 9 in the end wall 3 and are components of said bayonet coupling. On the outside of the sleeve 1 there are two L-profile mounting flanges 12,13 extending essentially axially to the sleeve with their free legs directed outwards from each other.

Figure 6:
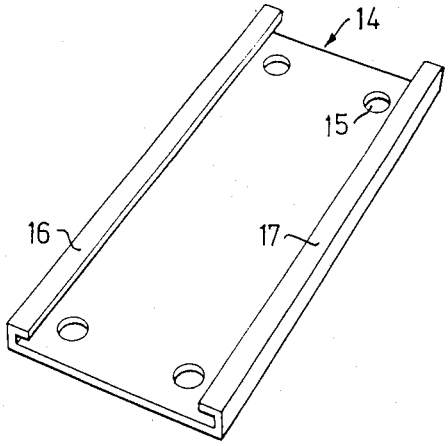
FIG. 6 shows in perspective a wall bracket for the holder in FIG. 1.

FIG. 6 shows an element 14 which cooperates with the mounting flanges 12,13 on the sleeve 1. This element is provided with a number of screw holes 15 and is designed to be screwed onto a supporting surface. Along its longitudinal edges it has L-profile flanges, inside the free legs of which the free legs of the mounting flanges 12,13 on the sleeve 1 can be inserted when mounting the holder on the bracket element 14. Suitably the two mounting flanges 12,13 on the sleeve 1 are not entirely parallel but somewhat convergent, as the flanges 16,17 on the bracket element 14 should be, thus fixing the sleeve to the wall bracket.

A holder according to the invention can be placed anywhere on a supporting surface, for example horizontally or vertically on a wall, on the underside of a cabinet or on a pillar or the like.

The cover-like end wall 3 can be attached in four different angular positions in relation to the sleeve, making it possible to obtain even wear on all of the tearing teeth 5.

The cover-like end wall 3 and the sleeve 1 are preferably individually moulded in one piece in plastic, thus making manufacture both simple and inexpensive.

The embodiment of a paper roll holder revealed in FIGS. 7*a* and 7*b* includes a first portion 18 of hard plastic and a second portion 19 of somewhat more flexible plastic which can be transparent. The hard plastic portion 18, which is a sort of frame in the holder, has a flat wall 20 which can be fixed to a supporting surface, and for this purpose is provided with four screw holes 21. Furthermore this portion has two flat side walls 22,23, a first end wall 24 and a second end wall 25, which extends substantially farther out from the wall 20 than the two side walls 22,23 and the first end wall 24. The second end wall 25 is provided with a dispenser opening 36 (shown in FIG. 9) for the paper web, which is pulsed out centrally from the interior of a paper roll which during use has one end abutting against the second end wall 25. From the second end wall 25, there extends a wall portion 26, which is comprised in the tearing means, the free end of which describes a curve similar to a sine-wave. In the opposite direction from the second end wall 25 there extends a rounded wall portion 27, which is designed to surround one end portion of a paper roll placed in the hard plastic portion 18.

The projecting wave tops 28 on the tear means 26 are intended to serve as protective projections for preventing a user from scratching or cutting himself on the sharp tearing teeth 29 arranged in the spaces between the wave tops 28. These tearing teeth are arranged along one edge of a long flexible plate 30, which is bent into an annular shape and inserted inside the wall portion 27 provided with wave tops or protective projections 28 and is spring-biased against the same.

The edge 31 of the sleeve portion 19 is provided with three projecting ridges, two of which 32,33 are visible in FIG. 7*a*. The hard plastic portion 18 is in turn provided with three grooves interacting with these ridges, two of which 34,35 are visible in FIG. 7*a*. When attaching the sleeve portion 19 to the hard plastic portion 18, the ridge designated 33 in FIG. 7*a* is inserted first into the corresponding groove 35 in the hard plastic portion. The sleeve portion is then pressed together somewhat so that the two ridges designated 32 can be inserted inside the two side walls 22,23 of the hard plastic portion 18 and snap into the groove 34 therein.

As can be seen in FIG. 9, the plate 30 provided with tearing teeth 29 is a little shorter than the inner circumference of the wall portion 26. The plate 30 bent into a ring can thus be easily pressed together and turned to different positions in the wall portion 26 so as to provide even wear to all of the tearing teeth. Furthermore, the plate can be easily replaced when worn out. As is already mentioned, FIG. 9 shows the opening 36 through which the paper web is pulled. This opening is not round but has extensions 37,38 and 39 in three different directions.

A paper roll placed in the holder can, when most of the roll has been used and only a few windings remain, collapse in the direction towards the wall portion of the holder against which it rests. If the holder is, for example, mounted on the underside of a cabinet, there is a risk that the roll will collapse in the direction of the extension 38. Thanks to the extensions however, it is possible to continue to pull out the paper web from the interior of the roll even after the roll has collapsed.

The invention is not limited to the embodiments described here, since a number of modifications of the same are possible within the scope of the following patent claims.

For example, a holder according to the invention can be made so that it stands upright resting on the end directly opposite to the end wall with the pull opening for the paper web. For such an embodiment it is, however, suitable that the holder be provided with a handle.

I claim:

1. A holder for paper rolls with central dispensing of the paper from the interior of the roll, said roll comprising a housing adapted to be mounted on a supporting surface and which has an end wall having a dispensing opening for the paper web, about which opening there is an at least substantially cylindrical tearing means for the paper web, said tearing means projecting from the end surface and having at its outer end sharp, substantially pointed tearing teeth for tearing off the paper web, the tearing means having at its outer end a plurality of spaced protective projections which extend beyond the sharp, substantially pointed tearing teeth, at least one of which teeth is disposed between adjacent protecting projections, said projections having inclined surfaces to protect the user's hand and fingers from the sharp teeth, said protective projections having substantially sine-wave-shaped free edges with a wave amplitude substantially greater than the length of the tearing teeth.

2. Holder according to claim 1, in which the dipensing opening for the paper web extends in several directions corresponding to directions in which the force of gravity acts on the paper roll in various mounted positions of the holder.

3. A holder for paper rolls with central dispensing of the paper from the interior of the roll, said roll comprising a housing adapted to be mounted on a supporting surface and which has an end wall having a dispensing opening for the paper web, about which opening there is an at least substantially cylindrical tearing means for the paper web, said tearing means projecting from the end surface and having at its outer end sharp, substantially pointed tearing teeth for tearing off the paper web, the tearing means having at its outer end a plurality of spaced protective projections which extend beyond the sharp, substantially pointed tearing teeth, at least one of which teeth is disposed between adjacent protecting projections, said projections having inclined surfaces to protect the user's hand and fingers from the sharp teeth, the tear means having an outer tubular portion with a substantially sine-wave-shaped free end with a wave amplitude substantially greater than the length of the tearing teeth, said teeth being disposed in one side edge of an elongated flexible plate, which is slightly shorter than the interior circumference of the tubular portion and when mounted in the tearing means is bent into a ring shape and is spring-mounted inside said tubular portion, whereby the tops of the sine-wave-shaped free edge of said tubular portion serve as protective projections and the tearing teeth on the annularly bent plate are accessible for tearing off the paper web only in the spaces between the wave tops.

4. Holder according to claim 3, in which the dispensing opening for the paper web extends in several directions corresponding to directions in which the force of gravity acts on the paper roll in various mounted positions of the holder.

* * * * *